US005797272A

United States Patent [19]

James

[11] Patent Number: 5,797,272

[45] Date of Patent: Aug. 25, 1998

[54] VACUUM DEWATERING OF DESICCANT BRINES

[75] Inventor: Robert Wilton James, St Marys, Australia

[73] Assignee: F F Seeley Nominees Pty Ltd, St Marys, Australia

[21] Appl. No.: 750,541

[22] PCT Filed: May 29, 1995

[86] PCT No.: PCT/AU95/00314

§ 371 Date: Nov. 27, 1996

§ 102(e) Date: Nov. 27, 1996

[87] PCT Pub. No.: WO95/33161

PCT Pub. Date: Dec. 7, 1995

[30] Foreign Application Priority Data

May 30, 1994 [AU] Australia ..... PM 5926

[51] Int. Cl.[6] ..... F25B 17/02

[52] U.S. Cl. ..... 62/93; 62/238.3; 62/271

[58] Field of Search ..... 62/93, 271, 238.3

[56] References Cited

U.S. PATENT DOCUMENTS

| | | | |
|---|---|---|---|
| 2,355,828 | 8/1944 | Taylor . | |
| 2,556,250 | 6/1951 | Bauman . | |
| 3,266,784 | 8/1966 | Saito . | |
| 4,355,683 | 10/1982 | Griffiths . | |
| 4,903,503 | 2/1990 | Meckler | 62/238.5 |
| 5,092,135 | 3/1992 | Cameron | 62/271 |
| 5,097,668 | 3/1992 | Albers et al. | 62/271 X |
| 5,327,739 | 7/1994 | Ingersoll et al. | 62/93 X |

FOREIGN PATENT DOCUMENTS

| | | |
|---|---|---|
| 18676/88 | 1/1989 | Australia . |
| 50591/93 | 6/1994 | Australia . |
| 2272845 | 6/1994 | United Kingdom . |
| WO 94/01204 | 1/1994 | WIPO . |

*Primary Examiner*—Christopher Kilner

*Attorney, Agent, or Firm*—Watts, Hoffmann, Fisher & Heinke Co., L.P.A.

[57] ABSTRACT

Desiccant brine is heated and diluted in an air drier by coming into contact with air to be cooled in an evaporative cooler but is regenerated by dewatering in a vacuum chamber, from which it is discharged first into a sump, and then back into the vacuum chamber. Both the desiccant brine and air are heated in the air drier and the hot brine when in the vacuum chamber has a temperature above atmospheric, which provides a higher vapor pressure and its water is readily vaporized. The higher efficiency reduces the amount of heat input required, and thereby reduces the extent of heat exchanger requirement.

10 Claims, 3 Drawing Sheets

VACUUM DEWATERING OF DESICCANT BRINES

This invention relates to dewatering of desiccant brines, utilising a vacuum technique in lieu of the conventional high energy heating.

BACKGROUND OF THE INVENTION

Air conditioners fall into two general categories, the first being of the so called refrigerative type which comprises a closed circuit of refrigerant and lubricant which is pumped by means of a reciprocating or scroll pump through a condenser wherein the refrigerant is mostly if not entirely converted to liquid, and is then expanded in an evaporator wherein the liquid converts back to gas, and thereby absorbs latent heat to provide the refrigeration. A coefficient of performance of about 3 is frequently achieved with such refrigerant type air conditioners, and they are in common use.

A much less expensive type is the evaporative cooler wherein water passes over an absorbent pad from which it is evaporated by a passage of ambient air, and is cooled. For relatively dry atmospheres, the coefficient of performance is very much greater than can be achieved with more expensive refrigerator type of air conditioners, and consequently there is much demand for such coolers. However, difficulties are encountered in the more humid climates, and no evaporation at all will occur when the humidity of the air is 100%. Furthermore, in climates where the humidity is high, although not as high as 100%, the addition of more water vapour to the air is not acceptable and in some instances there is a requirement for heat exchangers to separate the cooled but more humid air. However, because of the relatively small range of humidity within which evaporation can take place, the temperature differential of the evaporated and unevaporated air is small and as a consequence, heat exchangers if used need large surface areas. These problems have been very well recognised and much effort has been made to solve them, mainly through the use of desiccants. Hygroscopic material such as lithium bromide is very effective in absorbing moisture from the atmosphere, but whereas evaporation of moisture will result in cooling, condensation results in heating and in prior art evaporative air conditioners wherein desiccants first dry the air, it has been considered necessary to use additional heat exchangers. A common method of regeneration of desiccant is by the application of further heat (for example, gas flames) but this still further increases the energy input and further heat exchangers are required. Because of the bulk and cost of heat exchangers, some efforts have been made to utilise multiple stages of desiccants, and for example reference can be made to the U.S. Pat. No. 5,170,633, Kaplan. Reference can also be made to the U.S. Pat. No. 4,869,070, Assaf. Along with Albers (U.S. Pat. No. 5,097,668), these specifications contain the prior art which Applicant believes is the most relevant to this specification.

Further relevant prior art exists in the so called "water refrigerator". Water is said to be quite unsuitable for use in refrigerators of the type using closed circuits because firstly of its very low vapour pressure and secondly of its high specific volume at low temperatures. However, it is well recognised that it is possible to maintain a high degree of vacuum, and for example, at about 7° C. (45° F.) the vapour pressure is about 10 millibars (0.15 psi) and the corresponding specific volume of vapour is about 125 $m^3$ per kilogram (2000 cubic feet per pound). This large volume requires removal of vapour if the evaporation is to be continuous, and in installations where water has been used as a refrigerant, such as vegetable cooling devices, vacuum pumps have been supplemented by refrigerant evaporators within a vacuum chamber which assist in condensation of the water vapour while still in the chamber. This invention utilises a vacuum dewatering technique, but without refrigeration. An alternative which has been considered but as far as is known to the Applicant has not been used, is use of high pressure steam discharging through a nozzle upstream from a venturi which is in communication with a vacuum chamber, but this is not considered viable for air conditioning purposes, and in any case steam ejector pumps are notoriously of very low efficiency This invention has for its main object the simplification of desiccant regeneration, utilising a vacuum dewatering device, but with less heat exchange requirement. As said, application of further heat for drying desiccant usually requires association with further heat exchangers.

BRIEF SUMMARY OF THE INVENTION

In this invention, brine which has been heated and diluted by absorption of water vapour is dewatered by vacuum created In a vacuum chamber by a vacuum pump. There are at least two hydraulic circuits, the first of which includes a pump to deliver dewatered desiccant brine to an air drier, where it becomes diluted. The second circuit delivers the diluted brine to the vacuum chamber wherein it is dewatered.

Since dewatering by evaporation is endothermic by about the same amount that dehumidifying air is exothermic, it is possible to greatly reduce the amount of additional heat input to regenerate the desiccant, and consequently reduce the heat exchanger requirements.

This invention is associated with an evaporative air conditioner wherein air has been separately dried by desiccants, and the dewatering, or regeneration of desiccant by vacuum. It further relates to recovering distilled water for delivery to an evaporative cooler through which dry air is passed. This latter feature is of particular importance when the evaporation which takes place in the evaporative cooler is such that with other than distilled water there could be a build up of salt deposits.

DESCRIPTION OF PREFERRED EMBODIMENTS

Three embodiments of the invention are described hereunder in some detail with reference to and are illustrated in the accompanying drawings in which.

Figure 1:
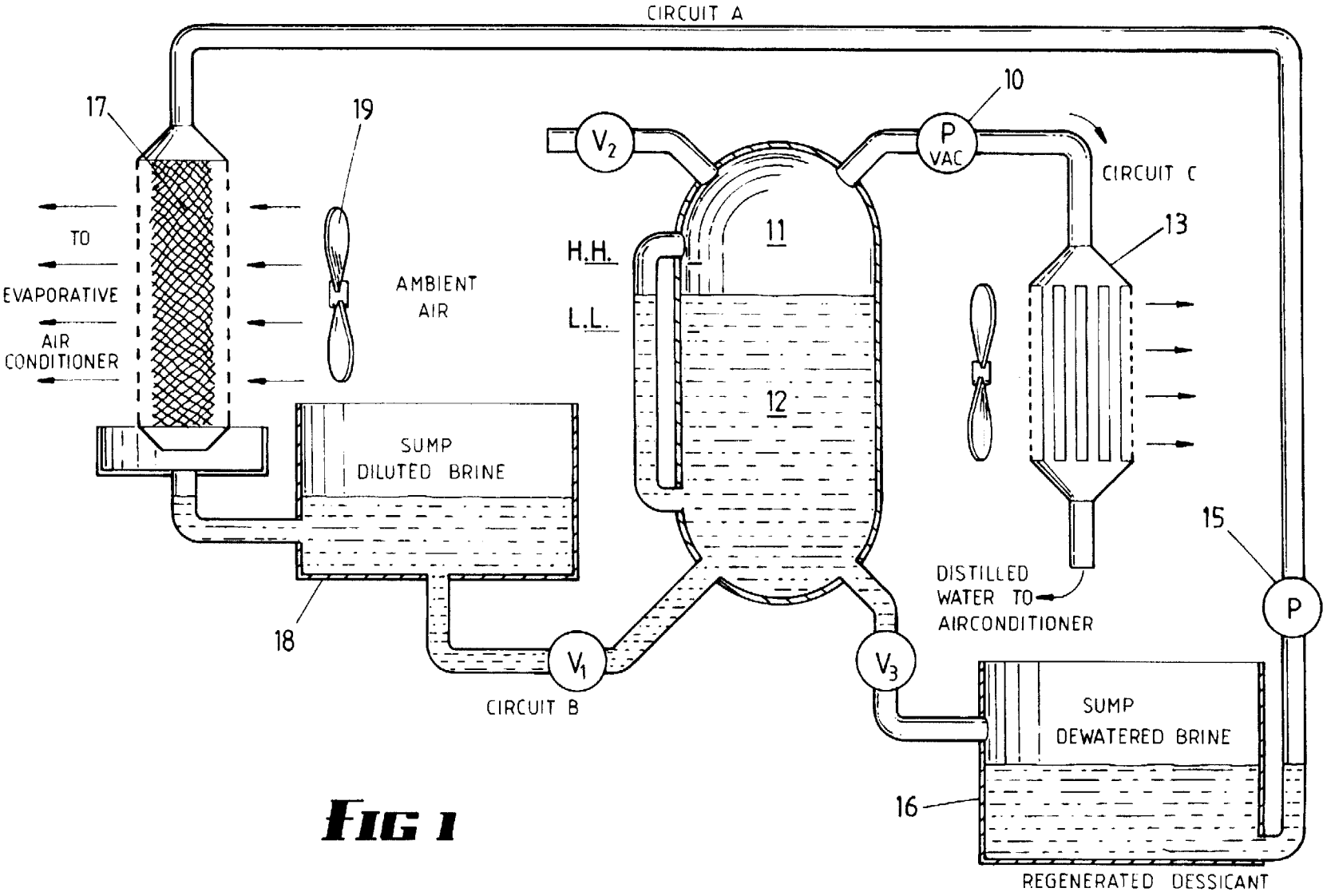
FIG. 1 illustrates an installation utilising a vacuum chamber for rapid evaporation of water from a watery desiccant, and delivery of warm dry air to be used in an evaporative cooler.

There are at least two, and in these embodiments, three basic hydraulic circuits, marked CIRCUIT A, CIRCUIT B and CIRCUIT C on the drawings.

Referring first to the embodiment of FIG. 1, a vacuum pump 10 withdraws moisture vapour from a vacuum chamber 11 which contains a watery desiccant solution 12, thereby increasing desiccant concentration, and the vapour removed from the chamber 11, in circuit C is condensed as distilled water in a heat exchanger 13, and, is subsequently delivered as pure cold water to moisten the evaporative pads in an airconditioner (not shown).

In hydraulic circuit A, there is provided a pump 15 which pumps dewatered, and thereby regenerated desiccant from a sump 16 to an air drier absorption pad 17 through which the brine percolates to be delivered to a second sump 18 as a hot dewatered brine. Moist ambient air is driven by a fan 19 through the pad 17 and the moisture is absorbed by the desiccant solution so that warm dry air is delivered to an evaporative air cooler (not shown).

There are provided three valves which control liquid level in chamber 11 between low level (L-L) and high level (H-L). The valves are designated V1, V2 and V3. The following sequences occur:

(1) V1 open, V2 closed and V3 closed, the vacuum is maintained in chamber 11 drawing hot watery desiccant solution from sump 18 until the high level "H-L" is reached.

(2) V1 closed, V2 closed and V3 closed, the vacuum pump 10 evaporates the water thereby dewatering and cooling the hot desiccant solution 12, until the water level drops to "L-L".

(3) V1 closed, V2 open and V3 open, the concentrated desiccant solution runs in circuit B from chamber 11 into the sump 16.

With this arrangement the dewatering takes place with low energy input, and the distilled water is likely to be cool thereby partly offsetting the higher temperature of the dried air emitting from the pad 17.

Figure 2:
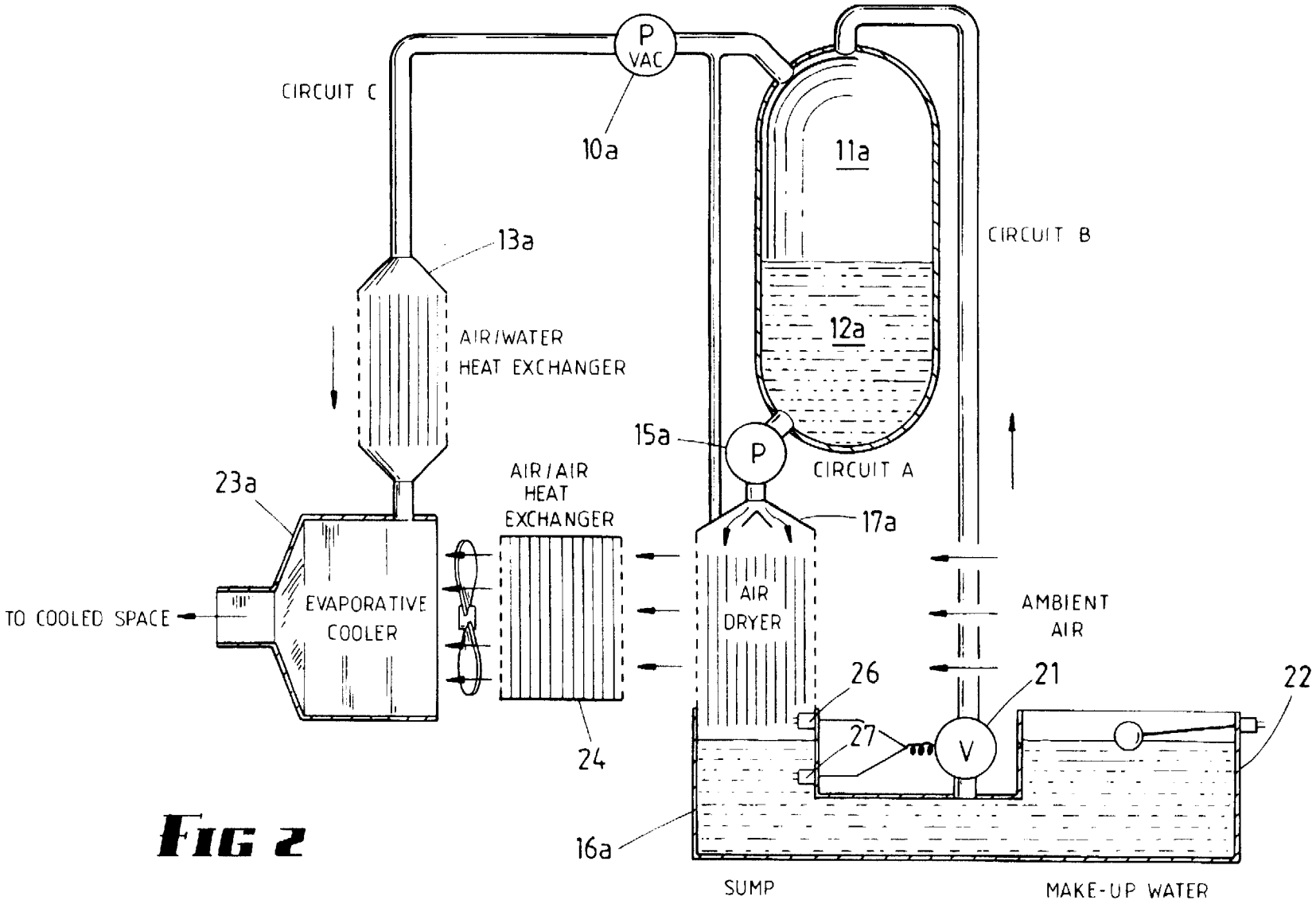
FIG. 2 shows an alternative of the invention wherein air is dried and cooled before entering an evaporative cooler.

In FIG. 2, circuits A, B and C function as in FIG. 1. The desiccant is again a solution of hygroscopic salt, for example lithium bromide, and exposed in an air drier 17*a* to a passage of ambient air by falling as a stream into sump 16*a* from where it is drawn upwardly as a cold watery brine through a valve 21 into a vacuum chamber 11*a* by a vacuum pump 10*a*. Make up water is supplied as in the first embodiment through a secondary sump 22, being an extension of sump 16*a*. This is likely to be hot, and constitute a low grade heat source The metering pump 15*a* meters brine from chamber 11*a* to air drier 17*a* and also it functions as a valve to separate the low pressure which exists in the chamber 11*a* from the ambient pressure which exists in the air drier 17*a*. After having been subjected to moist air in air drier 17*a*, the condensation of the air borne moisture results in heating and sump 16*a* contains hot dilute brine which recirculates as the brine is delivered to the chamber 11*a* under vacuum, through valve 21. In some instances it is necessary to incorporate a small heat exchanger between valve 21 and chamber 11*a*.

The vacuum pump 10*a* withdraws vapour yielded from the air drier 17*a*, and that vapour is condensed in heat exchanger 13*a* and delivered to an evaporative cooler 23*a* as distilled water which has been cooled almost to ambient temperature. Heat exchanger 13*a* is shown as an air/water heat exchanger. The dry air which emits from air drier 17*a* is cooled as it passes through an air/air heat exchanger 24, and subjected to further humidification in evaporative cooler 23*a*. The desiccant brine level in the base of the air drier 17*a* is controlled by the two probes 26 and 27 which open the valve 21 when water level falls below the probe 27 and closes it when the water level raises above probe 26.

With this embodiment it is not necessary to have the very low pressure in the chamber 11*a* because of the high temperature which is achieved in the air drier 17*a*. As a consequence, the vacuum pump 10*a* can be of a simple and inexpensive construction, as can the heat exchangers 13*a* and 24. Furthermore, the FIG. 2 embodiment illustrates a continuous process, compared to the sequential process of FIG. 1.

Figure 3:
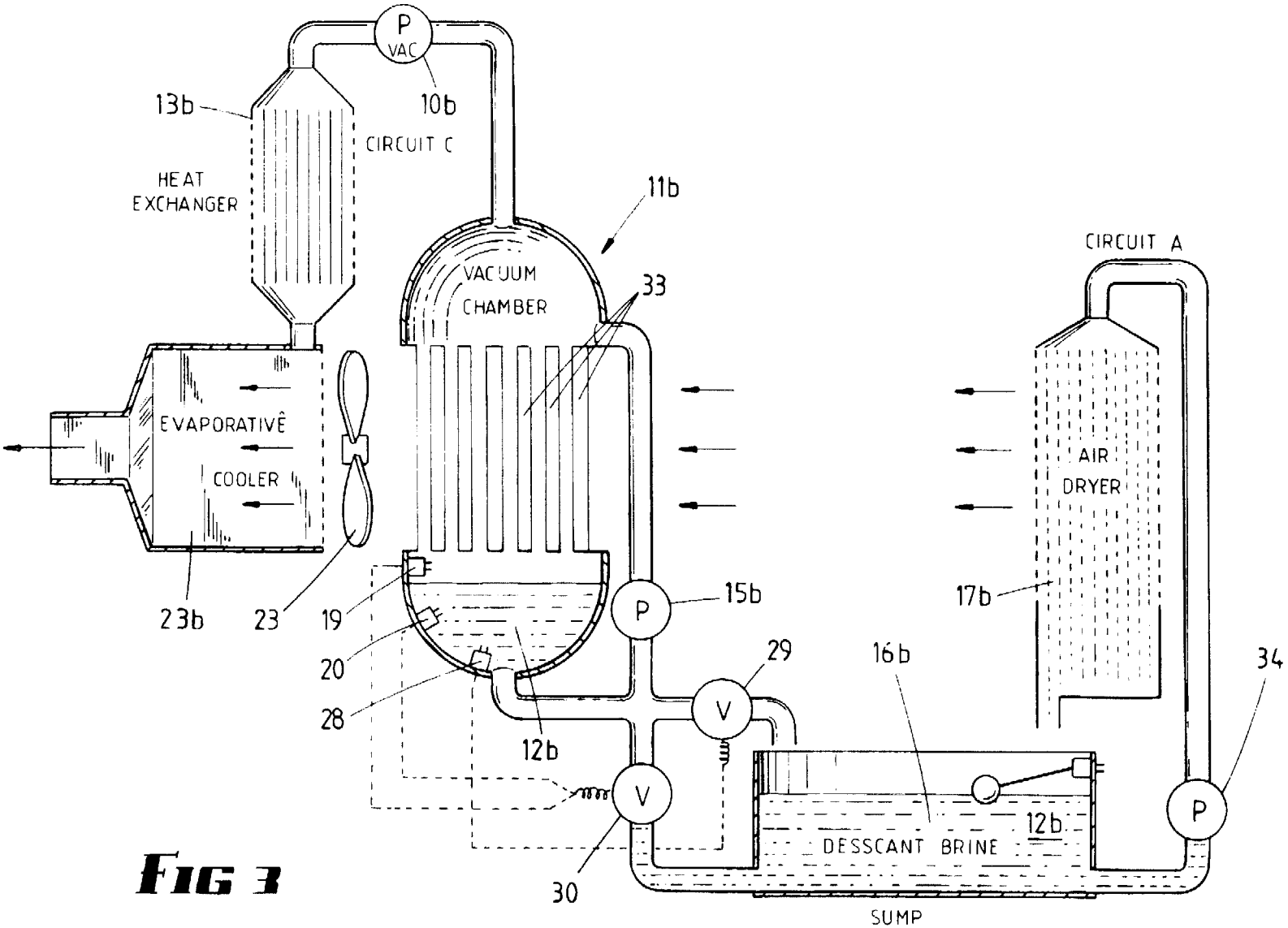
FIG. 3 shows a further alternative wherein the air is hot and dry when passing through a water/air heat exchanger employing vacuum evaporation.

The third embodiment of FIG. 3 is a variation of FIGS. 1 and 2, and corresponding components bear the same designation numerals, but with the suffix 'b'. There is a third "low level" probe 28 which causes temporary opening of valve 29 to replenish brine in sump 16*b* after it has been drained through valve 30, by pump 15*b*. Valves 29 and 30 are electrically interlocked to achieve this. Replenishment of brine into vacuum chamber 11*b* is effected basically by vacuum pump 10*b*, supplemented by circulating pump 15*b*.

The FIG. 3 embodiment is also continuous. The vacuum chamber 11*b* in FIG. 3 includes a plurality of heat exchange pipes 33 between which ambient air passes, after having been heated and dried in air drier 17*b*. This raises vapour pressure within chamber 11*b*, and increases vacuum pump efficiency, in turn cooling the air before it enters the evaporative cooler 23*b*. Pump 15*b* causes the desiccant brine to flow through pipes 33, and that also enhances evaporation. Pump 34 circulates desiccant brine through circuit A, and the air drier 17*b*. Circuits B and C function as in the first and second embodiments.

In all three embodiments, desiccant 12 is at least warm, if not hot, when being dewatered, and in the third embodiment the heat in the chamber 12*b* is supplemented by hot air passing over heat exchange pipes 33. This enhances evaporation of water in chamber 11*b*, and that evaporation is further enhanced by circulation of watery desiccant through pipes 33. It is not always possible to avoid further heating, but the requirement is much reduced, with a consequential cost saving in heat exchanger capacity.

The claims defining the invention are as follows:

1. Means for vacuum dewatering of diluted desiccant brine, comprising a vacuum chamber, a vacuum pump in fluid flow communication with an upper end of said chamber, a sump at a level below said vacuum chamber, and an air drier, a hydraulic flow passage including a valve extending from said vacuum chamber to said sump, first and second hydraulic circuits, said first hydraulic circuit comprising a pump operable to deliver dewatered desiccant brine through a hydraulic conduit to said air drier so as to effect drying of air when passing through said air drier, with consequential aqueous dilution of said brine, said second hydraulic circuit comprising a second hydraulic conduit, and means to deliver said diluted brine to said vacuum chamber, wherein low vapour pressure created by actuation of said vacuum pump effects dewatering of said diluted brine by evaporation.

2. Means according to claim 1 further comprising a third hydraulic circuit including a heat exchanger in fluid flow communication with said vacuum pump in a configuration wherein water vapour removed from said vacuum chamber by said vacuum pump is condensed as distilled water.

3. Means according to claim 2 further comprising an evaporative air cooler, and a hydraulic conduit communicating between said air cooler and said heat exchanger to conduct said distilled water to said air cooler for evaporation therein.

4. Means according to claim 2 comprising a second sump located at a level below said air drier, arranged to receive said diluted desiccant brine, said second circuit including a hydraulic conduit containing a first valve extending from said second sump to a lower portion of said vacuum chamber, a second valve in an upper portion of said vacuum chamber openable to ambient air, and a further hydraulic conduit containing a third valve and extending from said lower portion of said vacuum chamber to the first said sump for delivery of dewatered desiccant brine thereto from said chamber.

5. Means according to claim 2 wherein said first circuit comprises a hydraulic conduit extending between a lower portion of said vacuum chamber and said air drier, and said pump is a metering pump in that said hydraulic conduit.

6. Means according to claim 2 wherein said second circuit comprises a hydraulic conduit extending from said sump to an upper portion of said vacuum chamber, said second hydraulic conduit containing a valve which, when open, allows upward flow of desiccant under influence of atmospheric pressure from said sump to said chamber when said vacuum pump is operating.

7. Means according to claim 2 wherein said vacuum chamber comprises an upper portion, a lower portion, a plurality of pipes extending between said portions, said second circuit comprising a hydraulic drain conduit extending from said lower portion, two branches of said drain conduit terminating one below normal brine level in said sump and the other above said normal brine level, a respective valve in each said branch, said drain conduit also having a further branch extending to said upper portion of said vacuum chamber, and a circulating pump in said further branch.

8. A method of improving effectiveness of an evaporative air cooler, comprising a. passing air through an air drier while simultaneously passing a dewatered desiccant brine through said drier in contact with said air, with consequential drying of the air and aqueous dilution of the desiccant, b. transferring said desiccant brine to a sump, and from the sump to a vacuum chamber, c. actuating a vacuum pump to withdraw water vapour from said vacuum chamber and thereby dewater said diluted desiccant, d. passing said water vapour through a heat exchanger to cool and condense said water vapour into distilled water e. passing said distilled water to an evaporative air cooler and humidifying and cooling air by evaporation of said distilled water.

9. A method according to claim 8 further comprising circulating desiccant brine from said sump, through said vacuum chamber thereby dewatering said brine, through said air drier, and back to said sump.

10. A method according to claim 9 further comprising circulating said brine through heat exchange pipes which join upper and lower portions of said vacuum chamber, passing air issuing from said air drier over said heat exchange pipes.

* * * * *